United States Patent [19]

Greenbaum

[11] 4,432,381

[45] Feb. 21, 1984

[54] WINDBREAKER

[76] Inventor: George Greenbaum, 790 Boylston St., Boston, Mass. 02199

[21] Appl. No.: 386,734

[22] Filed: Jun. 9, 1982

[51] Int. Cl.[3] ..... A45F 1/00; A01G 9/00

[52] U.S. Cl. ..... 135/87; 135/117; 135/901; 135/902; 47/17

[58] Field of Search ..... 135/119, 106, DIG. 9, 135/900–902, 117, 87, 120; 47/131, 126, 29, 17; 403/341, 292–293, 173; 49/390, 371, 74; 160/135, 184; 52/585; 24/339; 40/606–607

[56] References Cited

U.S. PATENT DOCUMENTS

| | | | |
|---|---|---|---|
| 1,816,301 | 7/1931 | Sundell | 24/339 |
| 2,596,064 | 5/1952 | Bishop et al. | 40/606 |
| 2,791,851 | 5/1957 | Richter | 40/606 |
| 3,165,110 | 1/1965 | Brooks | 135/119 |
| 4,063,585 | 12/1977 | Stanley | 160/135 |
| 4,214,392 | 7/1980 | Virsen | 40/606 |

*Primary Examiner*—Richard J. Apley
*Assistant Examiner*—S. R. Crow
*Attorney, Agent, or Firm*—Thompson, Birch, Gauthier & Samuels

[57] ABSTRACT

A windbreak which is formed of a post secured to a frame and sheet material is secured to the frame. The frame is comprised of grooved rods which secure sheet material via tube-like strips. The post is comprised of a plurality of rods and a clamp secures the rods. The adjoining rods define channels and the clamp includes projections which extend into the channels. Fittings are secured to the upper ends of the rod of the post and the frame is secured to the fittings. Fittings are further secured to the frame by dowel-like members.

10 Claims, 15 Drawing Figures

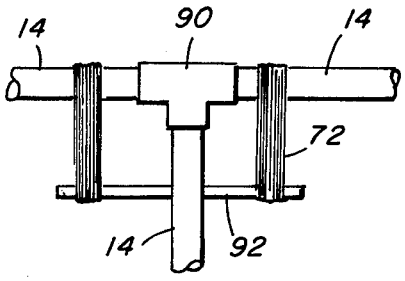
FIG. 9
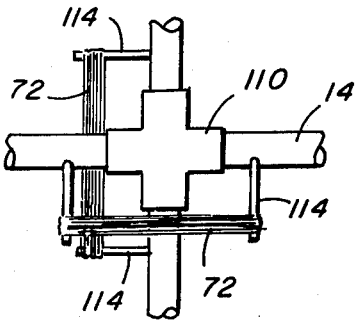
FIG. 11
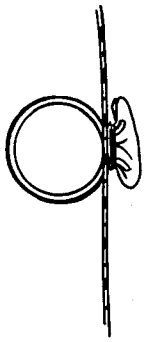
FIG. 14
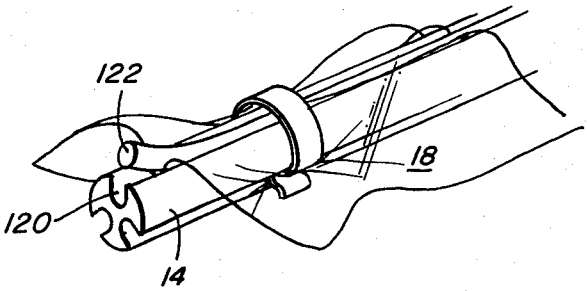
FIG. 13
FIG. 12
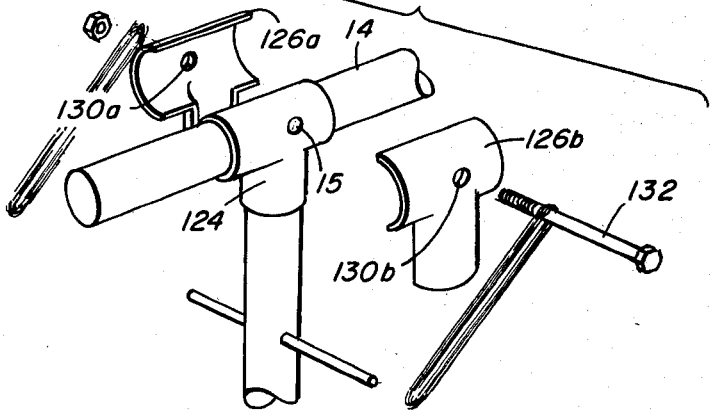
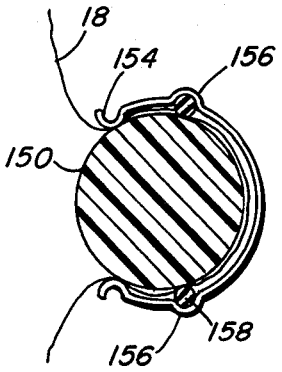
FIG. 15

WINDBREAKER

BACKGROUND AND BRIEF SUMMARY OF THE INVENTION

The invention relates to structures particularly adapted for use in an agricultural environment.

In the growing of crops and the like, particularly on a large scale, to prevent soil erosion from wind and to enhance moisture retention, trees are planted and used to create a windbreak. Obviously, once trees are planted and mature, they are fixed. However, the need for a flexible windbreak system exists but to date any such suggestions have been cost prohibitive primarily because of the strength required in such structures.

I have conceived a structure which is low cost, easy to assemble and capable of a wide variety of structural modifications and uses.

Broadly, the invention comprises a multi-rod post, the rods secured one to the other in a unique way. Secured to the upper end of the post are a plurality of fittings to which are joined grooved rods in a defined configuration. Sheet material is joined to the rods either as described in a previous application of mine, for example Ser. No. 352,289, filed on Feb. 25, 1982 and the applications and patents referenced therein; or by the use of a novel spring clip arrangement. The joints of the rods secured to the post are strengthened through the use of pins or dowels extending through the rods and secured by stretch wrap, thereby drawing the rods into the fittings, or alternatively, by clamping members.

My invention broadly comprises a post formed from a plurality of rods. The rods when clamped together for a composite outer surface characterized by grooves or channels. A clamping member(s) which has projections on its inner surface encircles the rods, the projections mating with the grooves. When assembled, the projections prevent relative movement among the rods when the post is subject to stress. The upper ends of the rods when clamped are spaced such that fitting may be slidably received on the ends. A frame is joined to the post by the fittings which frame has secured thereto sheet material in a manner as described in my aforementioned application.

In a preferred embodiment, a spacer is placed between the rods in the clamped position. The spacer includes projections which mate with the grooves defined by the composite inner surface of the rods. Further, the joints of the frame secured to the pot are strengthened. Pins or dowels are passed through adjacent rods of a joint and bands of stretch wrap join the dowels drawing the dowels together and thereby drawing the adjacent rods into the fitting.

BRIEF DESCRIPTION OF THE DRAWINGS

FIG. 9 is a front view of a T-joint of the frame of FIG. 1;

FIG. 11 is a front view of a cross joint of the frame of FIG. 1;

FIG. 12 is a perspective view of an alternative embodiment of a joint strengthener;

FIG. 13 is a perspective view of a structure to secure sheet material to the frame;

FIG. 14 is a sectional end view of an alternative device to secure sheet material to the frame.

FIG. 15 is a side sectional view of a further alternative device to secure sheet material to the frame.

DESCRIPTION OF THE PREFERRED EMBODIMENT

Figure 1:
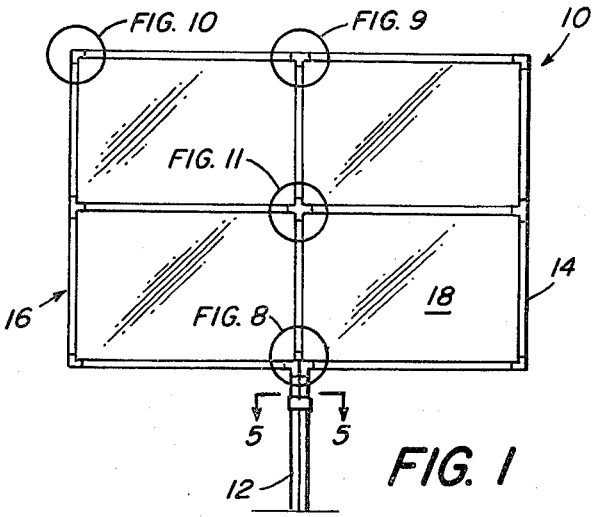
FIG. 1 is a front view of a windbreak embodying my invention.

FIG. 1 is a front view of a preferred embodiment of my invention and comprises a single windbreak 10 which may be secured in the edge of a field of crops or the like; or adjacent to like windbreaks or windbreaks of a different configuration, the windbreak comprises a post 12 of grooved rods 14 to which is joined a frame 16 to which is secured sheet material 18. Prior to describing the windbreak 10 in specific detail, reference will be made to other configurations which are shown schematically. The schematic configurations will embody the various fittings and methods for securing the multiple rods together; for strengthening joints and for securing the sheet materials to the structure so formed. Myriad combinations are possible and for this reason, the structure of FIG. 1 and alternative embodiments of securing multiple rods strengthening joints and securing sheet material will be described in reference to FIG. 1; although it will be clear to one skilled in the art, any suitable combinations may be used depending upon the strength of the structure required and its intended use or function such as a windbreak, a solar reflector, shed, silo, retractable screens, etc.

Figure 2:
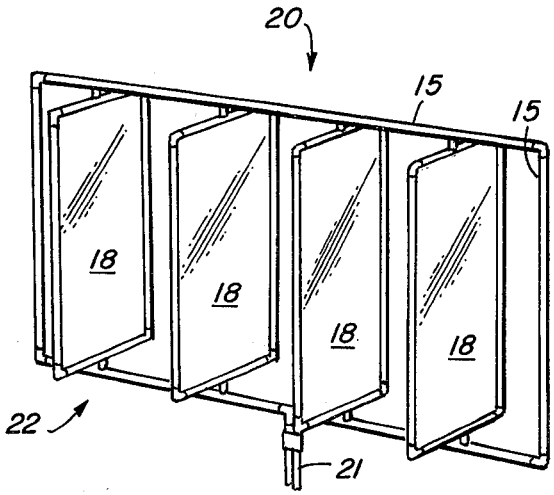
FIG. 2 is a perspective view of a louvered windbreak.

FIG. 2 shows a louvered windbreak 20. The windbreak 20 controls the direction and force of the wind which flows therethrough in contradistinction to the windbreak of FIGS. 1 and 4 which are static. The windbreak 20 comprises a post 21 and rods 15 defining a frame 22. Rectangular shaped panels 23 comprised of rods 14 have sheet material 18 secured thereto. The panels 23 are rotatably secured to the frame 22 in vertical side by side relationship. The panels 23 are joined to the frame 22 by a threaded union assembly 24 or similar device. When it is desired to rotate any of the panels, the nut on the union (at either end) is backed off the panel, rotated to the desired position and the nut tightened down. The width of the panels may be varied, for example, when adjacent panesl lie in substantically the same plane (closed portion), their longitudinal edges may overlap, abut or be spaced apart from one another. The panels may be arrayed horizontally, both horizontally and vertically, or a combination of both. Alternatively, they may be secured to the frames at various angles.

Figure 3:
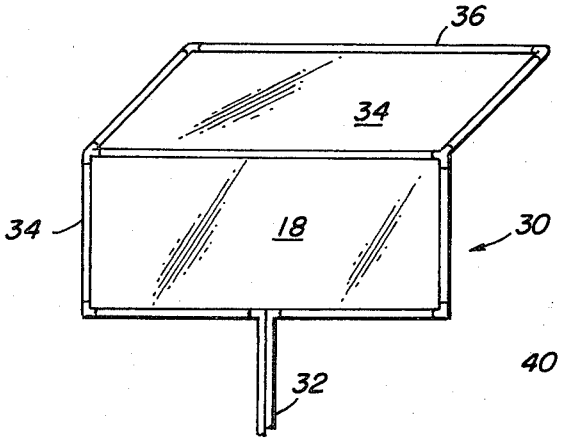
FIG. 3 is a schematic of a windbreak-solar reflector combination.

FIG. 3 shows a windbreak 30 having a post 32 to which is secured a first frame 34 covered with sheet material 18 to form a windbreak. A second frame 36 is joined to the first frame and a material 34 suitable for reflecting solar energy is secured to the second frame. The windbreak-solar reflector may be adapted for rotation as desired.

Figure 4:
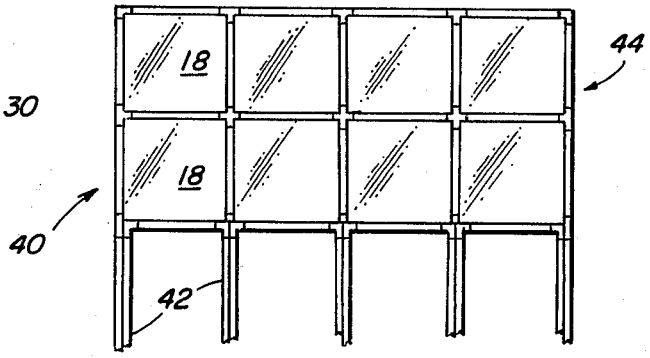
FIG. 4 is a front view of a windbreak fence arrangement.

In FIG. 4, a windscreen fence 40 is illustrated with posts 42 to which is joined a frame 44 to which is secured sheet material 18 thereby defining the fence 40.

Figure 5:
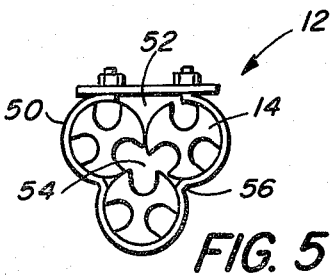
FIG. 5 is a top sectional view of the post of FIG. 1 taken along lines 5—5 of FIG. 1.
Figure 8:
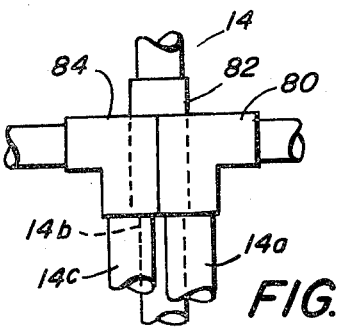
FIG. 8 is a front view of the post frame juncture of FIG. 1.
Figure 10:
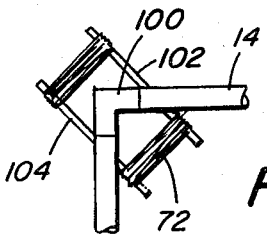
FIG. 10 is a front view of a corner joint of the frame of FIG. 1.

Returning to FIG. 1, the basic windbreak 10 comprises a multiple rod post 12. The post is comprised of rods 14 secured together as shown in FIG. 5. The frame 16 comprises rods 14 which are joined together by suitable fittings. The sheet material 18 is secured to the frame 16. The upper ends of the rods 14 comprising the post include fittings to which are secured the frame (FIG. 8). The joints of the frame are strengthened as shown in FIG. 9 (T-joint); FIG. 10 (corner joint); and FIG. 11 (cross joint). The sheet material 18 is secured to the rods 14 in either of three ways as shown in FIG. 13 (groove with strip); FIG. 14 (ring), and FIG. 15 (alternate ring) thereby forming a windbreak or shield.

Figure 6:
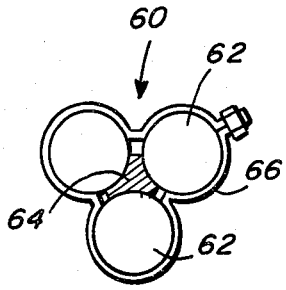
FIG. 6 is a top sectional view of an alternative embodiment of a post.

In FIG. 5, three rods 14 are shown joined together by a clamp 50. The three rods are clamped together as a unit include a composite outer surface having longitudinal grooves 52 defined by the outer surfaces of adjacent rods; a composite inner surface having longitudinal grooves 54 defined by the outer surfaces of adjacent rods. The inner surface of the clamp 50 is shaped to conform to the outer surfaces of the rods 14. The inner surface of the clamp 50 includes inwardly extending projections 56 which are received in the grooves 52. Bolts 56 pass through the ends of the clamp to secure the rods in place.

Where it is contemplated that the torsional forces (non-parallel to the longitudinal axis) acting on the post will be great, it will be advantageous to include a spacer to resist such forces. In FIG. 6, such an arrangement is shown in plan view where a post 60 comprises three rods 62 surrounding in nesting relationship a triangular spacer 64. A clamp 66, which functions as the clamp of FIG. 5, secured the rods 62.

FIGS. 5 and 6 have been shown with three rods without and with a spacer; two rods could be used or more than two, but it is believed three is optimal. The spacer may be rigid or resilient as desired and may extend for any length within the post.

Figure 7:
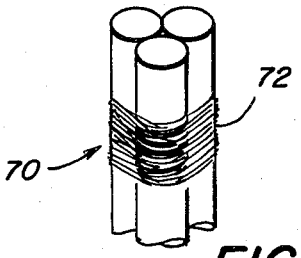
FIG. 7 is a perspective view of an alternative embodiment of a clamping member.

In FIG. 7, a post 70 is shown wherein three rods are secured together by 'stretch wrap' 72, a polyethylene or polyvinyl film available from the Mobil Corporation or Borden Company, respectively. This 'stretch wrap' has the ability to form an extremely strong bond when properly applied. The first layer (revolution about the rods) is applied and subsequent layers are applied under substantial elastic tension. The terminus of the strip may be adhesively or heat sealed resulting in the rods being joined under high compression. The application of the film is similar to applying an elastic bandage. As shown in FIG. 6, a spacer may be inserted between the rods. The width, number of layers and thickness of the film used will vary depending upon the strength of bond required for the particular application.

In addition to the strength of the multi-pole concept, its adaptability for diverse geometric configurations is unlimited.

In FIG. 8, the upper portion of the post 12 is shown. The rods 14 comprising the post 12 have fittings 80, 82 and 84 slidably secured on their upper ends. The rod 14(*a*) has a right angle fitting 80 secured thereto; the rods 14(*b*) has a sleeve 82 secured thereto; and the rod 14(*c*) has a right angle fitting secured thereto. These fittings, as with the fittings to be described for the joints of the frame, are slidably secured on the ends of the rods. They may be secured simply by friction, set screws, threads, bolts or by the structures shown in FIGS. 9–11 or variations thereof. If a spacer is used, the rods to which the fittings are secured are uniform in diameter. If no spacer is used, the upper ends of the rods may be slightly spaced apart to accomodate the walls of the fittings as shown in FIG. 8.

Thus, the post of the invention in addition to providing increased strength, may have secured thereto in a simple and economical manner a number of fittings to anchor the framework of the structure, here the windbreak. Any fitting 30°, 45°, 60°, etc., in any orientation may be successfully employed.

FIG. 9 is a front view of a T-joint strengthened in accordance with one aspect of my invention. The rods 14 are jointed by a T-fitting 90. A dowel 92 is secured to the perpendicular rod 14. Stretch wrap 72 clamps the parallel rods 14 to the dowel 92 and thereby strengthens the joint.

FIG. 10 is a front view of a corner joint strengthened in accordance with my invention. The rods 14 are secured to a right angle fitting 100. Dowels 102–104 pass through the rods 14 as shown; the dowels 102–104 in parallel relationship and at a 45° angle to the rods.

FIG. 11 illustrates a joint similar to the joint of FIG. 9. A four-way fitting 110 joins rods 14. Dowels 112 extends from one side of in-line rods 14 and dowels 114 extend from one side of in-line rods 14. Stretch wrap 72 is secured to the dowels 112 and 114, respectively. The dowels 112 and associated stretch wrap 72 lie in a plane offset from the dowels 114 and associated stretch wrap 72 of about 45°. The dowels may extend through the rods 14 as shown in FIGS. 9 and 10 such that four bands of stretch wrap would be used.

The angular relationship between rods and dowels may vary depending upon the nature of the joint to be strengthened. That is, the specifically disclosed rod-dowell angular relationship has been 45°–90° lying in the same plane. Depending upon the joint to be strengthened, this angular relationship will vary and it is not necessary that the dowels and rod lie in the same plane. As an example, if the joint to be strengthened is a 30° joint, then the dowels would pass through the rods at an angle to the longitudinal axis of the rod to accomplish the intended function. The intended function is to draw the rods into the fitting in which they are slidably secured. The stretch wrap when applied as a band creates a compressive force (similar to a rubber band). The angles and orientations selected for a particular joint will vary according to the compressive force desired and the mechanical strength of the rods and dowels necessary to sustain such force within their elastic limits.

An alternative way of strengthening joints is illustrated in FIG. 12 on a T-joint although the concept is applicable to any joint. Rods 14 are secured to a T-fitting 124. Two mating sleeves 126(*a*) and 126(*b*) in the form of T's characterized by apertures 130(*a*) and 130(*b*), respectively, embrace both the fitting 124 and a portion of the rods 14. The apertures 130–132 are aligned with passage 15 and the sleeves bolted one to the other, such that a bolt 132 passes entirely therethrough. The bolt 132 extends from the sleeves as shown. A dowel (or bolt) 134 passes through the vertical rod 14 in parallel with the bolt 132. Stretch wrap 72 is secured to the bolt 132 and dowel 134.

The sheet material 18 may be secured to the frame in either of three ways. In FIG. 13, a grooved rod 14 (such as disclosed in my aforementioned application which is hereby incorporated in its entirety in this application) has the sheet material 18 received in the groove 120 and an elongated strip 122 carries the sheet material into the groove and is secured by the strip 122. For additional strength, a spring clip 124 may be used.

Alternatively, as shown in a side sectional view in FIG. 14 (whether or not a grooved rod is used), a rod 140 has encircled thereabout a clamp 142 terminating in a U-shaped ends with the bends of the U's opposed to one another. The sheet material 18 is folded into the ends and secured with a loop 144.

Referring to FIG. 15, a rod 150 has film material 26 partially encircled thereabout. A clasp 152 terminating in rounded ends 154 includes concave surfaces 156 with respect to the outer surface of the rod 150. The clamp 152 may be of any desired width. Received between the surface 156 and the film 18 is a rubber strip 158 or the like which engages the sheet material securely. The clip engages the pipe and the rubber strips inserted in the concave recesses insure that there will be no slippage of the film material when placed under stress.

My invention includes several related concepts all of which are combined to provide a low cost structure embodying flexibility of design. Modifications to the disclosed embodiment will be within the skill of the art and are within the scope of my invention.

Although the invention has been described particularly with grooved rods, obviously the post can be comprised of smooth rods rather than grooved rods and in particular, the posts of FIG. 6 with smooth rods connected to standard fittings may be used wherein the sheet material would be secured in accordance with the disclosure of either FIG. 14 or FIG. 15.

Having described my invention, what I now claim is:

1. A structure which comprises:

a post comprised of a plurality of rods, the rods assembled in parallel relationship to define channels between them on their composite outer surface and their composite inner surface, and the upper ends of the rods spaced from one another when in a clamped position;

means to clamp the rods one to the other, said means having an inner surface with projections extending therefrom some of said projections mating with some of said channels, the projections inhibiting the movement of the rods one to the other when the post is subject to stress;

a plurality of grooved rods secured one to the other to define a frame;

means to secure the frame to the post, said means adapted to be slidably received on the upper ends of the rods in their clamped position, said means adapted to slidably receive the ends of at least some of the grooved rods of the frame; and sheet material secured to the frame by a resilient tube-like strip, which strip carries the sheet material with it into the grooves of the rods.

2. The structure of claim 1 which includes a spacer between the clamped rods which form the post.

3. The structure of claim 2 wherein the spacer includes projections on its outer surface, which projections are received between the inner channels of the clamped rods, which spacer inhibits the movement of the clamped rods one to the other when stress is applied to the post.

4. The structure of claim 1 which includes means to secure the grooved rods one to the other with an elastic-like adhesive plastic film, the film applied to the grooved rods in a band-like configuration.

5. The structure of claim 1 wherein the ends of the grooved rods are slidably received in fittings to form a joint and which includes means to strengthen the joint.

6. The structure of claim 5 wherein the means to strengthen the joint includes dowel-like members extending from the grooved rods of a joint and an elastic adhesive-like plastic film is wound about the dowels drawing the dowels together and thereby drawing the grooved rods to which the dowels are secured together and toward the fitting in which the grooved rods are received.

7. The structure of claim 6 wherein the dowels are in parallel relationship.

8. The structure of claim 5 which includes two half sleeves having apertures therein, the sleeves secured over a joint and joined thereto.

9. The structure of claim 1 wherein the frame is a first frame and which includes a second frame and a solar reflective material is secured to the second frame.

10. The structure of claim 1 wherein the frame comprises a plurality of longitudinal panels formed of grooved rods, the panels having sheet material secured thereto; the panels rotatably secured to the frame in side by side relationship whereby a louvered-like windbreak is formed.

* * * * *